US012716331B2

(12) United States Patent
Chochua et al.

(10) Patent No.: US 12,716,331 B2
(45) Date of Patent: Aug. 25, 2026

(54) SYSTEM AND METHOD FOR INJECTING A GAS INTO A SUBSURFACE GEOTHERMAL FORMATION

(71) Applicant: Schlumberger Technology Corporation, Sugar Land, TX (US)

(72) Inventors: Gocha Chochua, Sugar Land, TX (US); Arnaud Van Der Beken, Clamart (FR); Bruno Lecerf, Houston, TX (US); Adeline Moignard, Pau (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/226,395

(22) Filed: Jun. 3, 2025

(65) Prior Publication Data

US 2025/0369314 A1 Dec. 4, 2025

Related U.S. Application Data

(60) Provisional application No. 63/655,628, filed on Jun. 4, 2024.

(51) Int. Cl.
*E21B 41/00* (2006.01)
*F24T 10/20* (2018.01)

(52) U.S. Cl.
CPC ..... *E21B 41/0064* (2013.01); *F24T 10/20* (2018.05)

(58) Field of Classification Search
CPC ..... E21B 41/0064; F24T 10/20
See application file for complete search history.

(56) References Cited

U.S. PATENT DOCUMENTS

2011/0272166 A1* 11/2011 Hunt ..... F03G 4/074 166/402
2022/0065834 A1* 3/2022 Gadot ..... G01N 33/0047
2022/0219112 A1* 7/2022 Sigfússon ..... B01D 53/1475
2022/0373230 A1* 11/2022 Chorn ..... F03G 4/026
2023/0041084 A1* 2/2023 Smith ..... E21B 43/26
2023/0175365 A1* 6/2023 Musho ..... E21B 43/122 417/151

OTHER PUBLICATIONS

Virginie, H. et al., "Good practice guidelines on deep geothermal drilling and exploitation from experience in the Paris Basin (Dogger and Albian aquifers)", ADEME (Agence De l'environnement et de la Maitrise de l'Energie) and BRGM version, Oct. 2022, pp. 1-10.

* cited by examiner

*Primary Examiner* — Silvana C Runyan
(74) *Attorney, Agent, or Firm* — Kyle R. Miiller

(57) ABSTRACT

A system for injecting a gas into a geothermal reservoir includes an outer tubular and an inner tubular. The outer tubular is arranged within a wellbore and is configured to inject an aqueous solution. The inner tubular is arranged within the outer tubular, and includes a sparger near a downhole end of the inner tubular at a sparger depth from a surface. The sparger includes a plurality of holes. The sparger is configured to inject a gas into the aqueous solution via the plurality of holes. The sparger depth is between 150 and 1200 meters from the surface, and a reservoir depth of the geothermal reservoir from the surface is greater than the sparger depth.

19 Claims, 4 Drawing Sheets

SYSTEM AND METHOD FOR INJECTING A GAS INTO A SUBSURFACE GEOTHERMAL FORMATION

CROSS-REFERENCE TO RELATED APPLICATION

This application claims priority from U.S. Provisional Appl. No. 63/655,628 filed on Jun. 4, 2024, which is herein incorporated by reference in its entirety.

BACKGROUND OF THE INVENTION

Geothermal systems that extract thermal energy (e.g., heat) from a geothermal reservoir are generating considerable interest. A conventional geothermal reservoir is a volume of subsurface rock that contains a natural source of pressurized geothermal fluid that is heated by natural geological processes below the Earth's surface. The pressurized geothermal fluid can include hot water or brine. The pressurized geothermal fluid is used as a source of thermal energy. A geothermal well is drilled from the surface into and through the conventional geothermal reservoir. One or more fluids may be directed from the surface to the geothermal reservoir. The same well or another well may extract fluid heated by the geothermal reservoir.

Solutions are sought for sequestering or permanently storing the carbon dioxide in the subsurface. The carbon dioxide may be captured from various sources, such as from the ambient environment, from flue gases, or from industrial processes. Storing the carbon dioxide may reduce the carbon dioxide within the atmosphere, thereby reducing the greenhouse effect from the carbon dioxide. Solutions to efficiently store carbon dioxide into the subsurface formation are sought.

SUMMARY OF THE DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In an embodiment, a system for injecting a gas into a geothermal reservoir includes an outer tubular and an inner tubular. The outer tubular is arranged within a wellbore and is configured to inject an aqueous solution. The inner tubular is arranged within the outer tubular, and includes a sparger near a downhole end of the inner tubular at a sparger depth from a surface. The sparger includes a plurality of holes. The sparger is configured to inject a gas into the aqueous solution via the plurality of holes. The sparger depth is between 150 and 1200 meters from the surface, and a reservoir depth of the geothermal reservoir from the surface is greater than the sparger depth.

In another embodiment, a method of injecting a gas into a geothermal reservoir includes injecting an aqueous solution through an outer tubular, injecting a gas through an inner tubular, directing the gas into the aqueous solution, dissolving the gas in the aqueous solution to form an enriched brine, and injecting the enriched brine into the geothermal reservoir. The outer tubular is arranged within a wellbore, and the inner tubular is arranged within the outer tubular. A sparger near a downhole end of the inner tubular is arranged at a sparger depth from a surface, and the sparger includes a plurality of holes through which the gas is directed into the aqueous solution. The gas is dissolved within the wellbore within a dissolution length of 150 m from the sparger to form the enriched brine. The geothermal reservoir is at a geothermal depth greater than the sparger depth.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DISCLOSURE OF THE METHOD

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Figure 1:
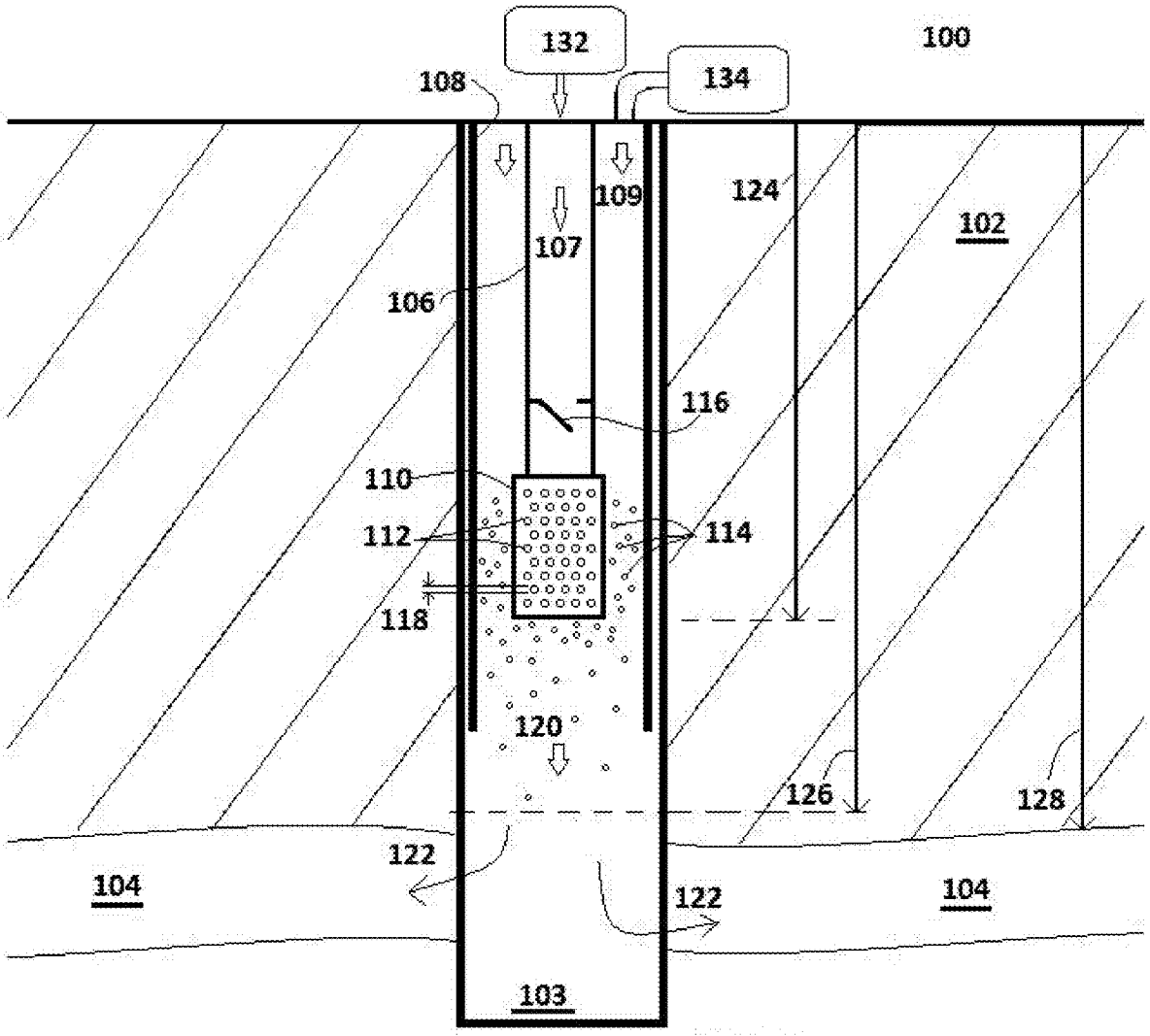
FIG. 1 is a schematic diagram of a system for injecting a gas into an aqueous stream within a wellbore extending through a geothermal reservoir, in accordance with aspects of the present disclosure.

FIG. 1 describes a system 100 for injecting a gas in a reservoir 104 of a subsurface formation 102 through a wellbore 103. The injected gas 107 may be a greenhouse gas, such as carbon dioxide ($CO_2$), captured from a industrial installation or from ambient air via an appropriate installation. The system 100 includes an inner injection tubular 106 (e.g., coiled tubing, drill pipe) for directing the gas 107 and an outer injection tubular 108 for carrying an aqueous stream 109, such as brine to the subsurface formation 102 via the wellbore 103. The inner tubular 106 and the outer tubular 108 are in fluid communication near the downhole end of the inner tubular 106, via a sparger 110 containing one or more holes 112 for flowing the gas 107 into the aqueous stream 109 in the outer tubular 108. Bubbles 114 may be formed in the aqueous stream 109 at or near the sparger 110.

The sparger 110 may be for instance a perforated pipe or a metal/polymer foam with the corresponding hole sizes 118. The inner tubular 106 is closed at its downhole end. Some gases, such as $CO_2$, are acidic gases that may be corrosive to some materials within the wellbore 103. As discussed below, the inner tubular 106 and sparger 110 facilitate addition of the acidic gas to the aqueous stream 109 within the wellbore 103 to reduce the quantity of materials of the system 100 exposed to the gas 107, and to reduce the duration of exposure of materials within the system 100 to the gas 107. The inner tubular 106 may include a pressure regulator 116 to ensure that there is no backflow of the gas stream 107. The pressure regulator 116 may be a passive valve (e.g., check valve), or an actively controlled valve.

The wellbore 103 is in fluid communication with the reservoir 104 so that the aqueous stream 109 may be injected into the reservoir 104. The reservoir 104 is at a reservoir depth 128 from the surface (e.g., Earth's surface). As discussed below, the sparger 110 may be arranged at a sparger depth 124 from the surface. The gas 107 injected through the sparger 110 is configured to mix with the aqueous stream 109 to form a gas-liquid mixture 120. At a dissolution depth 126 from the surface, a critical percentage of the gas 107 is dissolved into the aqueous stream 109, thereby forming an enriched brine 122. The critical percentage of dissolution of the gas 107 may be greater than 95%, 97%, or 99%. That is, the enriched brine 122 may be essentially free of bubbles. The system 100 also includes a first pump 132 to pump the gas 107 into the inner tubular 106, and a second pump 134 to pump the aqueous stream 109 into the outer tubular 108.

Figure 2:
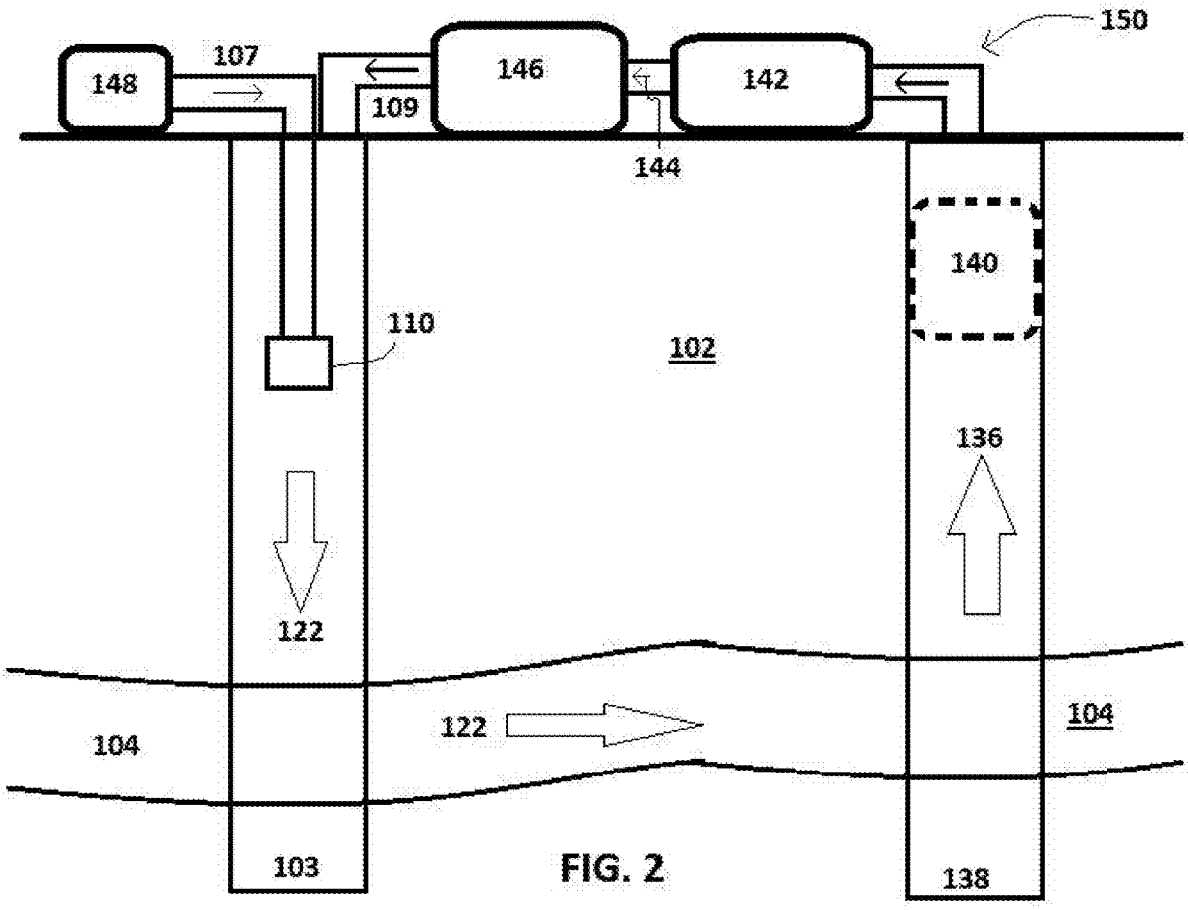
FIG. 2 is a schematic diagram of a combined geothermal system and gas sequestration system having an injector and producer wellbore extending through a geothermal reservoir, in accordance with aspects of the present disclosure.

As shown in FIG. 2, a combined system 152 having a geothermal system and a gas sequestration system may be configured to inject the enriched brine 122 into the formation 102 via the injector wellbore 103. At least a portion of the enriched brine 122 may flow through the reservoir 104. The dissolved gas 107 within the enriched brine 122 may be deposited within the reservoir 104 and the formation 102. For example, carbonates may be formed from dissolved $CO_2$ within the enriched brine 122. A heated brine 136 may enter a producer well 138 from the reservoir 104. The heated brine 136 has a lower quantity of the gas 107 dissolved therein than the enriched brine 122. Moreover, the heated brine 136 has a higher temperature than the enriched brine 122 injected to the formation 102. At least a portion of the heated brine 136 may originate from the aqueous stream 109 portion of the enriched brine 122 that entered the reservoir 104 via the injector well 103.

In some embodiments, a pump 140 may pump the heated brine 136 to a heat exchange system 142 on the surface. A circulation system of the combined system 152 may include the pump 140 fluidly coupled to the producer well 138. The pump 140 may be a subsurface pump within the producer well 138 or a surface pump. The heat exchange system 142 may be configured to transfer heat energy from the heated brine 136 to a working fluid (e.g., water, steam, organic-based fluid, $CO_2$), which in turn may be configured to produce work from the heat energy of the heated brine 136. The heat energy may be used in cooling and/or heating applications, and/or in thermodynamic cycles couples with a turbogenerator to generate electricity. A cooled brine 144 from the heat exchange system 142 may be processed (e.g., filtered, cooled, treated) by a processing system 146. In some embodiments, at least a portion of the cooled brine 144 may be returned to the injector wellbore 103 as the aqueous stream 109. Cooling the brine to less than 30° C. or less than 20° C. may increase the dissolution capacity of the aqueous stream 109 for the gas 107.

As discussed above with FIG. 1, the aqueous stream 109 is directed to the injector wellbore 103, and the gas 107 may be directed into the aqueous stream 109 via the sparger 110. In some embodiments, a source 148 of the gas 107 may be a pipeline, a storage vessel, or a carbon capture plant. In some embodiments, the gas 107 injected into the aqueous stream 109 may be greater than 95%, 98%, 99%, or 99.5% $CO_2$. In some embodiments, the gas 107 may be $CO_2$ purity qualities satisfactory for transmission via pipelines. That is, the gas 107 may consist essentially of $CO_2$.

The gas 107 (e.g., greenhouse gas, $CO_2$) is generally injected into the aqueous stream 109 at the sparger depth 124 as bubbles 114, at least in part because pressure of the gas stream 107 is greater than the aqueous stream 109 to ensure the aqueous stream 109 does not flow into the inner tubular 106. After being injected into the aqueous stream 109, the gas bubbles 114 start dissolving and fully dissolves in the enriched brine 122 after a certain distance at the dissolution depth 126.

The gas 107 dissolution in the aqueous stream 109 may be maximized by optimizing some parameters of the systems, as will be disclosed in more details below. This present application discusses the effects of the following three parameters on the dissolution of the gas (e.g., $CO_2$) in the aqueous stream 109 within the wellbore 103: sparger hole dimensions (e.g., hole diameter 118), sparging depth 124, and brine flow rate of the aqueous stream 109 into the wellbore 103.

The sparger hole dimensions (e.g., hole diameter 118) affect the size (e.g., diameter) of bubbles 114 in the gas-liquid mixture 120. It is believe that bubble diameters less than 1 mm increase the bubble interfacial area density and, hence, the mass transfer rate of the gas 107 into the enriched brine 122. Such critical dimensions 118 of the holes 112 are preferably between 0.5 and 1 mm so that, at the same time, the size is large enough to avoid plugging the holes 112. In general, round holes 112 provide the smallest bubbles 114. In some embodiments, the holes 112 of the sparger 110 are circular and the critical length 118 of the holes 112 is the diameter. However, depending on the shape of the holes 112, the critical length 118 could be length of two of its sides, length of width and height, etc.

Figure 3:
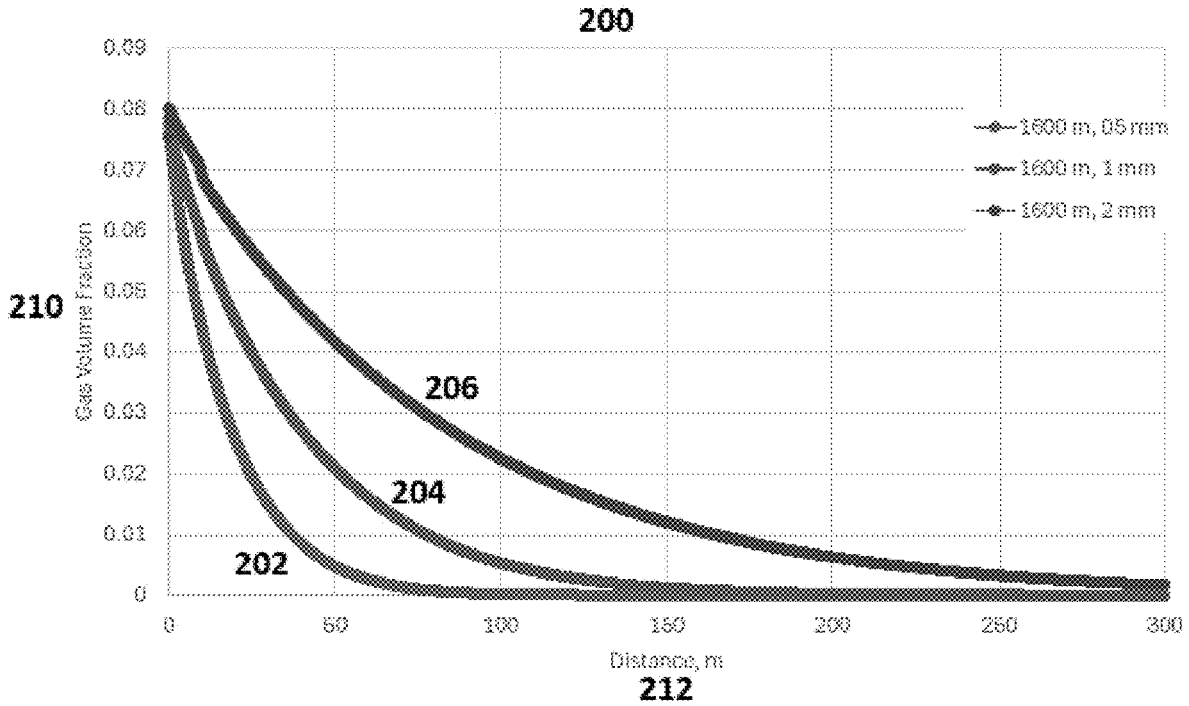
FIG. 3 is a graph showing the effect of sparger hole dimensions on the dissolution length, in accordance with aspects of the present disclosure.

With thorough understanding of the fluid properties of $CO_2$, the aqueous stream, multiphase models for bubble formation and dissolution, and Henry's law, models may assist in evaluating the effects of the critical length 118, sparging depth 124, and flow rates of the streams to form the enriched brine 122 for injection to the reservoir 104. FIG. 3 shows a graph 200 with three curves showing how the dimensions 118 of the sparger holes 112 affect the length after injection at which $CO_2$ is dissolved in the aqueous stream. The graph 200 illustrates how the gas volume fraction 210 of the $CO_2$ within the aqueous stream changes with the length 212 from the sparger 110. The length within the wellbore for dissolution is shown as the difference between the sparger depth 124 and the dissolution depth 126 as shown in FIG. 1.

All of the conditions for the three curves were the same, i.e., aqueous stream flow rate Q=300 $m^3$/hr and sparger depth=1600 m. Curve 202 is with a 0.5 mm hole, curve 204 with a 1 mm hole while curve 206 is for a 2 mm hole. As can be seen, if the hole dimensions is 1 mm or below, the gas volume fraction of $CO_2$ (i.e., the non-dissolved $CO_2$ fraction) decreases very quickly and, after 150 meters, essentially all $CO_2$ is dissolved. If the dimensions of the sparger hole are greater (for instance 2 mm), the distance for dissolving the $CO_2$ increases, i.e., about 300 m. Smaller bubbles generate a higher interfacial area for mass transfer due to the greater interfacial area density, $A_i$. Table 1 below illustrates the calculated interfacial area densities and dissolution distances in meters for three bubble sizes at conditions corresponding to FIG. 3.

TABLE 1

| Inlet Bubble Size (mm) | $A_i$ ($m^2/m^3$) | Dissolution distance (m) |
|---|---|---|
| 0.5 | 904 | 99% in 105 m |
| 1.0 | 452 | 99% in 166 m |
| 2 | 226 | 98% in 300 m |

Figure 4:
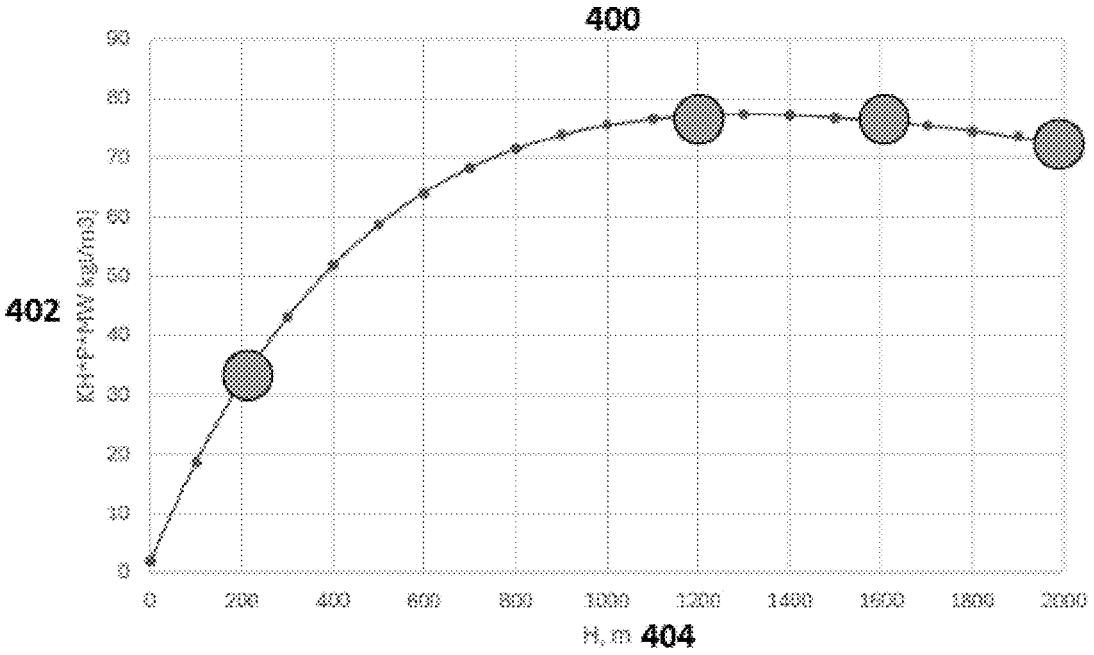
FIG. 4 is a graph showing the saturation concentration of $CO_2$ in an aqueous solution versus depth, in accordance with aspects of the present disclosure.

The maximum $CO_2$ saturation concentration within the aqueous stream varies based on the depth within the wellbore. That is, the temperature and pressure conditions within the wellbore affect the maximum concentration of $CO_2$ within the aqueous stream. The $CO_2$ concentration is a product of the temperature-dependent Henry's constant and pressure. Although Henry's constant generally decreases as temperature increases, a maximum concentration of $CO_2$ may be found due to the increased pressure at greater depths. For conditions evaluated herein, the $CO_2$ concentration has a maximum value at a depth of 1200 m, and decreases at higher depths due to the combined pressure and temperature rise effect. FIG. 4 illustrates a graph 400 representing saturation concentration of $CO_2$ 402 in the aqueous solution vs depth 404.

Figure 5:
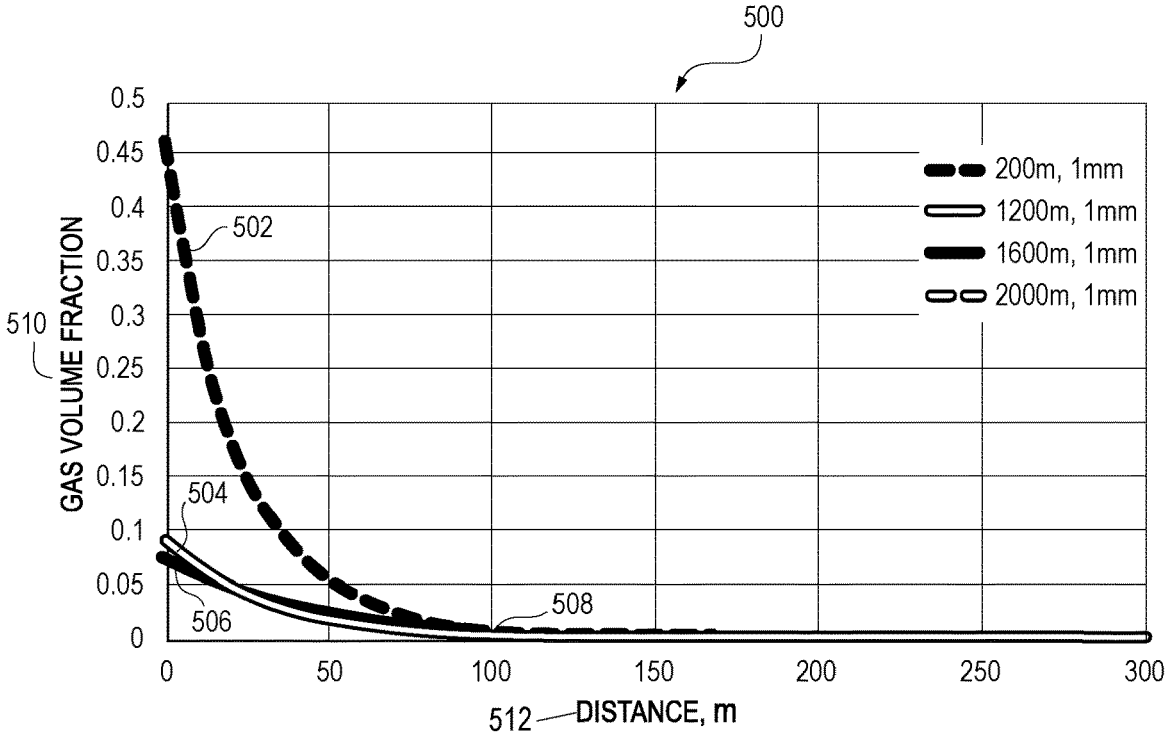
FIG. 5 is a graph showing the effect of the sparger depth on the dissolution length, in accordance with aspects of the present disclosure.

Although the maximum concentration of $CO_2$ within the enriched brine may be obtained at a depth of approximately 1200 m, it has been discovered that the dissolution distance may be less at another depth. FIG. 5 illustrates a graph 500 of how the gas volume fraction 510 of the $CO_2$ within the aqueous stream changes with the length 512 from the sparger 110 at various depths: 200 m, 1200 m, 1600 m, and 2000 m. For each of the depths, the other operating parameters are the following: hole size diameter=1 mm, and brine flow rate=300 $m^3$/hr. The gas-volume fraction shown with curve 502 for the sparger at 200 m is more than 4 times greater (approximately 0.46) than the gas-volume fraction shown with curves 504, 506, and 508 for the sparger at 1200 m (0.09), 1600 m (0.75), and 2000 m (0.7), respectively. However, the gas dissolves rapidly into the aqueous solution after injection at 200 m, such that approximately 99% of the gas is dissolved within approximately 101 m after injection at 200 m yet 99% of the gas is dissolved within approximately 198 m after injection at 2000 m. It is believed that the gas dissolves much more rapidly into the aqueous solution at the shallower depth (e.g., 200 m) due to the greater interfacial area density of the bubbles at 200 m compared to the greater depths. Thus, the length for 99% dissolution of $CO_2$ is less sensitive to the release depth for greater depths based at least in part on the comparable interfacial areas. Table 2 below illustrates the calculated interfacial area densities and dissolution distances in meters for injection at the four depths shown in FIG. 5.

TABLE 2

| Release Depth | $A_i$ ($m^2/m^3$) at sparger | Dissolution distance 99% (m) |
|---|---|---|
| 200 | 2741 | 101 m |
| 1200 | 521 | 134 m |

TABLE 2-continued

| Release Depth | $A_i$ ($m^2/m^3$) at sparger | Dissolution distance 99% (m) |
|---|---|---|
| 1600 | 452 | 166 m |
| 2000 | 426 | 198 m |

Installing the sparger at a shallower depth of about 200 meters results in the shortest $CO_2$ dissolution due to the larger $CO_2$ interfacial area at lower pressures and sufficient brine saturation concentration. The sparger depth 124 may therefore be set at a depth between 150 and 1200 meters, preferably between 150 and 400 meters, preferably between 150 and 250 meters. That enables the gas to be well dissolved within the aqueous solution for the enriched brine regardless of whether the reservoir is relatively shallow or deep.

Figure 6:
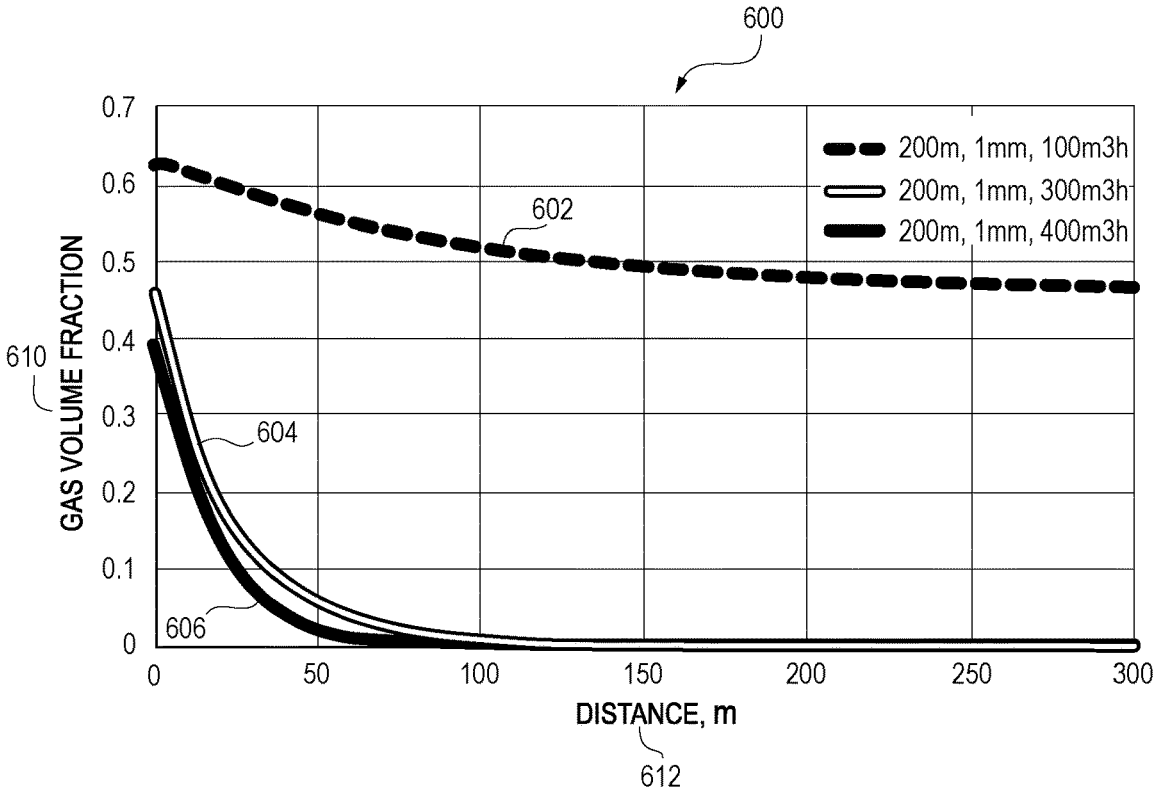
FIG. 6 is a graph showing the effect of the brine flow rate on the dissolution length, in accordance with aspects of the present disclosure.

The brine flow rate into the wellbore affects the dissolution of the gas into the aqueous stream. FIG. 6 illustrates a graph 600 of how the gas-volume fraction 610 of the $CO_2$ within the aqueous stream changes with the length 612 from the sparger 110 at various aqueous stream flow rates: 100 $m^3$/h, 300 $m^3$/h, and 400 $m^3$/h. For each flow rate of the aqueous stream, the other operating parameters are the following: hole size diameter=1 mm, and sparger depth 200 m. The gas-volume fraction shown for the lowest brine flow rate 100 $m^3$/h shown with curve 602 shows a significant increase in the dissolution length to 99% dissolution compared to the greater brine flow rates 300 $m^3$/h of curve 604 and 400 $m^3$/h of curve 606. It is believed that the brine corresponding to curve 602 becomes saturated and cannot readily dissolve more $CO_2$. Increasing the brine flow rate while keeping the gas flow rate steady enables more gas to be dissolved more rapidly. Table 3 below illustrates the calculated interfacial area densities and dissolution distances in meters for injection at the three brine flow rates shown in FIG. 6.

TABLE 2

| Brine flow rate ($m^3$/h) | $A_i$ ($m^2/m^3$) | Dissolution distance (m) |
|---|---|---|
| 100 | 3756 | 300 m at 47% |
| 300 | 2741 | 101 m at 99% |
| 400 | 2328 | 69 m at 99% |

An increase in the brine flow rate increases the bubble speed. At the same time, it increases the turbulence for better bubble mixing and brings more water mass compared to the mass of gas, thus allowing more gas absorption. Increasing the flow rate to >200 $m^3$/h shortens the dissolution length due to the combined effects of the higher turbulence and lower ambient $CO_2$ concentration in a typical wellbore. Flow rate above 300 $m^3$/hr enables a maximal sequestration of $CO_2$ of 100 kt/yr (i.e., 11 t/h) that corresponds to its saturation mass limit ratio.

Based on the above, the sparger hole critical length, the sparger depth, and the aqueous stream flow rate each affect the gas-volume fraction and dissolution length. Decreasing the sparger critical length to less than or equal to 1 mm decreases the dissolution length. Sparger depths of between 200 m and 400 m appear to exhibit reduced dissolution lengths than sparger depths greater than 1000 m despite greater possible $CO_2$ concentrations in aqueous streams at the greater depths. Moreover, increasing the flow rate of the aqueous stream to rates greater than 100 $m^3$/h, such as 300 $m^3$/h or 400 $m^3$/h, reduces the dissolution length based at least in part on greater turbulence within the aqueous stream and lower ambient gas dissolution within a volume of the aqueous stream. The gas dissolution length is less sensitive to release depths greater than 1200 m as the increase in pressure is negated by the increase in temperature at the greater depths. The dissolution rate of the gas into the aqueous stream is greatest at 200 m among those depths calculated based at least in part to the greater bubble interfacial area density $A_i$ at the shallower depth.

Geothermal systems may be combined with carbon dioxide sequestration through the embodiments described above. The $CO_2$ may be added to the aqueous streams at a designed depth within an injector wellbore such that the $CO_2$ may be dissolved within the enriched brine prior to injection into a thermal reservoir. While the enriched brine flows through the thermal reservoir and is heated, at least some of the dissolved $CO_2$ may be deposited within the formation and the thermal reservoir. The heated brine with a reduced concentration of $CO_2$ may be produced via a producer wellbore to facilitate transfer of thermal energy from the heated brine for a desired purpose. As discussed herein, the injection of the aqueous stream and $CO_2$ may be designed and controlled to attain a desired injection of $CO_2$ into the formation with reduced effects (e.g., corrosion) on components of the geothermal system due to the design, location, and control of the sparger. Designing the system so that the gas injection is operated with the sparger hole critical length, sparger depth, and aqueous stream flow rate controlled in view of the above description facilitates the combination of geothermal systems with carbon sequestration.

Other parameters may also be optimized such as the inlet brine temperature, that may be below 30° C., optionally between 10° C. and 22° C. Indeed, a decrease in the inlet brine temperature increases the saturation concentration of the brine and, hence, its ability to absorb $CO_2$ at the sparger.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system for injecting a gas into a geothermal reservoir, comprising:

an outer tubular within a wellbore, wherein the outer tubular is configured to inject an aqueous solution; and an inner tubular within the outer tubular, wherein the inner tubular comprises a closed downhole end and comprises a sparger near the closed downhole end of the inner tubular within the wellbore at a sparger depth from a surface, wherein the sparger comprises a plurality of holes, wherein the sparger is configured to inject the gas into the aqueous solution via the plurality of holes, wherein the inner tubular comprises a pressure regulator above the sparger, the pressure regulator being configured to prevent a backflow to the surface, and wherein the sparger depth is between 150 and 1200 meters from the surface, and a reservoir depth of the geothermal reservoir from the surface is greater than the sparger depth.

2. The system of claim 1, wherein each hole of the plurality of holes comprises a critical length between 0.5 mm and 1.0 mm.

3. The system of claim 2, wherein each hole of the plurality of holes comprises a circular hole.

4. The system of claim 1, wherein the sparger depth is between 150 and 250 meters.

5. The system of claim 1, wherein the sparger depth is between 50 to 150 meters less than the reservoir depth.

6. The system of claim 1, wherein the gas comprises greater than 95% carbon dioxide.

7. The system of claim 1, further comprising a pump, a producer well, and a heat exchange system, wherein;

the pump fluidly connects the geothermal reservoir via the producer well to the heat exchange system;

the heat exchange system is fluidly connected to the outer tubular; and a heated brine comprises the aqueous solution.

8. The system of claim 7, further comprising a processing system configured to cool the heated brine to a temperature between 10° C. and 22° C. to form a cooled brine, and to direct the cooled brine to the outer tubular.

9. The system of claim 1, further comprising a source of the gas, wherein the source comprises a carbon dioxide pipeline or a carbon capture plant.

10. A method of injecting a gas into a geothermal reservoir, comprising:

injecting an aqueous solution through an outer tubular within a wellbore;

injecting the gas through an inner tubular within the outer tubular to a sparger near a closed downhole end of the inner tubular at a sparger depth from a surface, wherein the inner tubular comprises a pressure regulator above the sparger, the pressure regulator being configured to prevent a backflow to the surface, and wherein the sparger comprises a plurality of holes;

directing the gas through the plurality of holes of the sparger into the aqueous solution;

dissolving the gas in the aqueous solution within the wellbore within a dissolution length of 150 m from the sparger to form an enriched brine; and injecting the enriched brine into the geothermal reservoir at a geothermal depth greater than the sparger depth.

11. The method of claim 10, wherein the sparger depth is between 200 and 400 meters from the surface.

12. The method of claim 11, wherein the injecting the aqueous solution comprises injecting the aqueous solution at a flow rate of 400 $m^3$/h, and injecting the gas comprises injecting the gas at a flow rate of 11 t/h.

13. The method of claim 12, wherein the plurality of holes comprises circular holes having a diameter between 0.5 mm and 1.0 mm.

14. The method of claim 10, comprising capturing the gas from a flue gas or an ambient environment, wherein the gas comprises greater than 95% carbon dioxide.

15. The method of claim 10, comprising pumping a heated brine from a producer well to a heat exchange system, wherein the producer well fluidly connects the geothermal reservoir to the heat exchange system.

16. The method of claim 15, comprising processing the heated brine from the heat exchange system to produce a cooled brine, and directing the cooled brine to the outer tubular as the aqueous solution.

17. The method of claim 16, wherein processing the heated brine comprises forming the cooled brine at temperatures between 10° C. and 22° C.

18. The method of claim 10, wherein dissolving the gas within the dissolution length comprises dissolving at least 99% of the gas within the aqueous solution.

19. The method of claim 10, comprising routing the gas to the inner tubular from a pipeline, wherein the gas consists essentially of carbon dioxide.

* * * * *